United States Patent [19]

Vola et al.

[11] 3,943,886

[45] Mar. 16, 1976

[54] DEVELOPING APPARATUS FOR ELECTROSTATIC CHARGE IMAGES

[75] Inventors: Mathias J. J. M. Vola, Sittard; Gerardus A. J. Koeleman, Velden; Franciscus M. J. Peeters, Grubbenvorst, all of Netherlands

[73] Assignee: Oce-van der Grinten N.V., Venlo, Netherlands

[22] Filed: Dec. 16, 1974

[21] Appl. No.: 532,843

[30] Foreign Application Priority Data

Dec. 17, 1973 Netherlands ..... 7317261
Mar. 27, 1974 Netherlands ..... 7404121

[52] U.S. Cl. ..... 118/637
[51] Int. Cl.[2] ..... G03G 15/08
[58] Field of Search .... 118/637; 355/3 DD; 427/18; 96/15 D

[56] References Cited

UNITED STATES PATENTS

| | | | |
|---|---|---|---|
| 3,003,462 | 10/1961 | Streich, Sr. | 118/637 |
| 3,117,884 | 1/1964 | Greig | 118/637 |
| 3,345,294 | 10/1967 | Cooper | 118/637 |
| 3,547,077 | 12/1970 | Sage | 118/637 |
| 3,639,051 | 2/1972 | Charlap et al. | 355/3 DD |
| 3,654,902 | 4/1972 | Hakanson | 118/637 |
| 3,724,422 | 4/1973 | Latone et al. | 118/637 |
| 3,753,420 | 8/1973 | Post et al. | 118/637 |
| 3,828,730 | 8/1974 | Yamashita et al. | 118/637 |
| 3,877,413 | 4/1975 | Rowell et al. | 118/637 |
| 3,882,821 | 5/1975 | Katayama et al. | 118/637 |

*Primary Examiner*—Mervin Stein
*Assistant Examiner*—Douglas Salser
*Attorney, Agent, or Firm*—Albert C. Johnston

[57] ABSTRACT

An improved apparatus is provided for developing an electrostatic charge image on a support being moved through a magnetic brush-forming field between a permanent magnet and a rotating cylinder that transports a powder mixture of toner particles and magnetizable carrier particles into said field from a supply of the mixture held in a tray. A wall of the tray bordering the path of the mixture on the cylinder is formed with an edge over which an excess of powder escapes instead of accumulating objectionably in a region between the support and the cylinder. As toner becomes deficient in the tray it is replenished by fresh powder mixture properly proportioned for use, which mixture is supplied into a shorter part of a trough that also receives the powder returned down the cylinder from the magnetic brush region. Screw conveyor means in this trough move its contents to an off-center opening therein from which mixed toner and carrier particles fall and are guided toward the center of the tray so as to be mixed with the material in the tray by especially formed mixing elements rotating therein. Further intensive mixing is assured by subjecting the mixture passing from the tray to the field of a permanent magnet mounted outside the tray in closely spaced relation to a lower portion of the surface of the cylinder. A central mixing element carries a brush for sweeping a window in the tray bottom through which the toner concentration is optically scanned. The rotary mixing elements have shafts mounted in powder shedding roller bearing bushings fitted into the side walls of the tray.

16 Claims, 10 Drawing Figures

DEVELOPING APPARATUS FOR ELECTROSTATIC CHARGE IMAGES

This invention relates to an apparatus for the development of an electrostatic charge image on a support by use of a powder mixture comprising magnetizable carrier particles and particles of a dye or toner.

A type of such apparatus is known, for instance from U.S. Pat. No. 3,639,051, in which a tray for holding a quantity of the powder mixture contains a magnetic brush forming cylinder mounted in bearings between the side walls and near the rear wall of the tray so that this cylinder can rotate freely, and which includes a permanent magnet cooperating with the cylinder and means for transporting supports carrying charge images over the cylinder, together with at least two mixing organs mounted in bearings between the side walls near the bottom of the tray and means for replenishing the supply of powder mixture in the tray.

Such a developing apparatus is used, for instance, in an electrophotographic copying machine, to bring the toner particles onto a sheetlike photoconductive material provided with a latent charge image. The cylinder is caused to rotate with its lower side immersed in the mixture of magnetizable particles and toner particles, so that a part of the mixture is carried upwards by the cylinder through the space between its surface and the rear wall of the tray. As the mixture arrives in the field of the permanent magnet, the magnetizable particles are lifted by the field to form a kind of brush on the surface of the cylinder. This brush comes into contact with the photoconductive material, which is guided over the upper side of the cylinder in a direction opposite to the direction of rotation of the cylinder. As a result, toner particles are attracted by the charge image onto the photoconductive material and convert the charge image into a powder image. The magnetizable particles and the non-attracted toner particles fall from the cylinder back into the tray upon leaving the magnetic field. At the same time the used quantity of toner particles is replenished by the addition of toner to the mixture in the tray in response to an optical measuring device, and the magnetizable particles and toner particles are continually mixed by the mixing organs in the tray so as to keep a mixture of substantially constant mixing proportion present near the cylinder.

It has been found that not only must the used quantity of toner particles be replenished, but also the magnetizable particles should be refreshed regularly, because these particles lose their activity progressively the more they have taken part in the developing process.

It is important, further, that no significant pressure be built up in the mixture of magnetizable particles and toner particles in the tray, for otherwise the toner particles will agglomerate. It therefore is desirable that the transport of the mixture to the cylinder from the place where the particles fall from the cylinder back into the tray, and/or from the place where the mixture is replenished, not be effected entirely by mechanical transport elements.

When a copying machine making use of apparatus of the type mentioned is set into operation after a considerable period of rest, it often occurs that the tribo-electric charge level of the developing power initially is relatively low, as a result of which objectionably weak copies are made during the initial operating period. In addition, for instance as a result of variations of the conditions of operation, the composition of the developing powder often differs too much from place to place in the tray, causing variations of the tribo-electric charge level. Consequently, the quality of the copies made undergoes great fluctuations and may sometimes even become unacceptable.

It therefore is also an object of the present invention to provide a developing apparatus of the type mentioned whereby the developing powder when leaving the tray always has a substantially homogeneous composition and an amply sufficient tribo-electric charge level.

According to the invention, it has been found that this can be attained by providing the developing apparatus not only with the magnet required for the formation of the magnetic brush but also with a magnet mounted on or close to the outside of the rear wall of the tray, or powder receptacle, at a location near a lower portion of the surface of the cylinder. Surprisingly it has appeared that the magnet so mounted also causes the formation of a higher magnetic brush having a very uniform meniscus between the rotating cylinder and the other magnet, which favorably affects the quality of the copies made.

According to the present invention, the mixture in the tray is replenished with a fresh mixture of magnetizable particles and toner particles in a certain mixing proportion, and the transport of the particles to the cylinder is effected to the extent practicable by a natural distribution of the particles. In the latter regard, however, a problem occurs in that the level of the mixture in the tray near the cylinder is of critical importance, since at too low or too high a level too little or too much, respectively, of the mixture is carried upwards by the cylinder, and in the latter case an accumulation of particles with an agglomerating or packing effect occurs in the upper working space which is bordered by the upper part of the cylinder, the rear wall of the tray and the sheetlike photoconductive material.

In order to obviate that problem, the apparatus according to the invention is provided not only with means for supplying a fresh mixture of magnetizable particles and toner particles to the tray but also with a powder overflow edge on the rear wall of the tray, which edge lies parallel to the axis of the cylinder at the level of a point between the highest point and the center of the cylinder. In consequence of this, the level of the mixture near the cylinder can be relatively high, because the accumulation mentioned cannot occur; instead, an excess of particles in the upper working space will escape freely over the overlow edge of the rear wall. Since a large part of the toner particles will already have been attracted by the photoconductive belt from the mixture in that space, the escaping mixture is relatively deficient in toner particles. It therefore can be removed without detriment, being replaced in the tray by a properly proportioned mixture of magnetizable particles and toner particles supplied into the tray.

As already indicated, it is of great importance that a mixture of magnetizable particles and toner particles having the same mixing proportion be present along the full length of the cylinder at all times. Since the mixing proportion of the particles falling down from any place along the cylinder depends on the extent to which the toner particles have been attracted by the electrostatic charge image on the support, this mixing proportion will usually vary over the length of the cylinder.

According to the invention, these variations in the mixing proportion are eliminated before the particles fall back into the tray, by the provision of a troughlike element parallel to the cylinder for receiving the powder mixture falling down from the cylinder, in the space between the front wall of the tray and the cylinder, this trough having an opening in it for discharging material from it toward the center of the tray, and having screwlike conveyor elements installed in it at either side of the opening for transporting the mixture received in the trough toward the opening.

In a preferred embodiment, the opening in the trough lies somewhat away from the center of the trough; a guide plate arranged below this opening is directed toward the center of the tray; and the means for supplying the fresh mixture of magnetizable particles and toner particles deliver this mixture into the shorter part of the trough. In this way the fresh mixture entering the trough is mixed with a smaller prportion of the particles which have fallen down from the cylinder, so that there is less difference between the respective quantities of particles moving toward the delivery opening in the trough from the parts of the trough at either side of this opening.

The screwlike conveying elements in the trough advantageously comprise a rotatable central shaft having a thread wound spirally about this shaft, with the extremities of the thread fixed on the shaft and the thread windings spaced from the shaft, i.e., their inside diameter being greater than the outside diameter of the shaft. The screwlike conveying elements at either side of the opening in the trough may have a common central shaft, or shafts connected with each other, and their respective thread windings may have opposite pitches. It is advantageous for these windings to overlap each other at least over the width of the opening in the trough and to oppose each other diametrically in the overlapping part.

In this way, the operation of the screwlike conveying elements causes parts of the mixture in the trough to be delivered through the trough opening alternatively from one side and then the other side of the opening in the trough. This is beneficial for the formation of a homogeneous mixture. For good mixing of the supplied fresh mixture with the mixture coming from the cylinder, it is further beneficial to provide a rod fixed parallel to the central shaft against the inner side of the thread windings of the screwlike conveying element located in the shorter part of the trough.

In order to assure good mixing of the particles which fall centrally into the tray through the trough opening with the particles already present in the tray, the mixing organs in the tray usually consist of rotatable oblong rollers which lie parallel to the cylinder and one behind another in a common plane. According to the invention, at least the roller closest to the front wall of the tray is provided with mixing pins arranged in two rows opposing each other diametrically, which pins protrude from the circumferential surface of the roller, and the mixing organ farthest from the front wall is provided with at least two bowlike protruding parts opposing each other diametrically, which parts each consists of a relatively thin rod that mainly extends parallel to the axis of the roller and is connected with the roller at least near the rod's extremities.

In one embodiment having three mixing rollers the central roller comprises three sections including a central section having a mainly smooth cylindrical surface and two end sections which are provided with mixing pins that protrude from the circumferential surface of the roller. In this case the roller farthest from the front wall is provided with three rods protruding as bows from its periphery. A first bow extends over almost the full length of this roller, and two shorter bows arranged diametrically opposite the first bow extend over lengths almost corresponding to the lengths of the end sections of the central roller.

In a second embodiment having three mixing rollers the central roller is identical with the first roller, i.e., the one closest to the front wall, and the third roller is provided with two identical bows arranged diametrically opposite each other. These bows are formed by wires which lie closer to the circumferential surface of the third roller along its central section than along its end sections.

A brush advantageously is fixed to the central part of the second mixing organ so as to sweep over a window in the bottom of the tray. This window serves in the known way for optically measuring the concentration of the toner particles in the mixture in the tray. The brush continually cleans the window in the bottom of the tray when the apparatus is in operation, so that the concentration of the toner particles in the mixture can be measured with greater precision.

Since the mixing organs in the tray are immersed completely in the mixture of magnetizable particles and toner particles, care must be taken to prevent powder particles, expecially the very fine toner particles, from reaching the bearings on which the mixing organs are supported in the side walls of the tray. For that purpose the invention contemplates that the mixing organs be mounted in those side walls on roller bearings placed in bearing bushings each having an end wall to which is joined a sleeve fitting in an opening in the side wall of the tray. The sleeve and the end wall of the bushing are made with an opening having a diameter fitting the shaft of the mixing organ, and the end wall of the bushing is cut away at one side of that opening to form a downwardly directed groove that extends through the side wall of the bushing. Thus, if powder particles should excape outward between the shaft of the mixing organ and the inner wall of the sleeve, these particles will fall downward through the groove and will therefore not travel into the roller bearings.

The bushings of the bearings which support the shafts of the mixing organs advantageously are each made with two diametrically opposite external surfaces forming flattenings on their side walls, and the respective bushings of the three adjacent mixing organs have their flattenings abutting one another near each side wall of the tray, so that the bushings cannot rotate with the shafts.

The invention will be further understood from the following detailed description and the accompanying drawings of illustrative embodiments. In the drawings.

Figure 1:
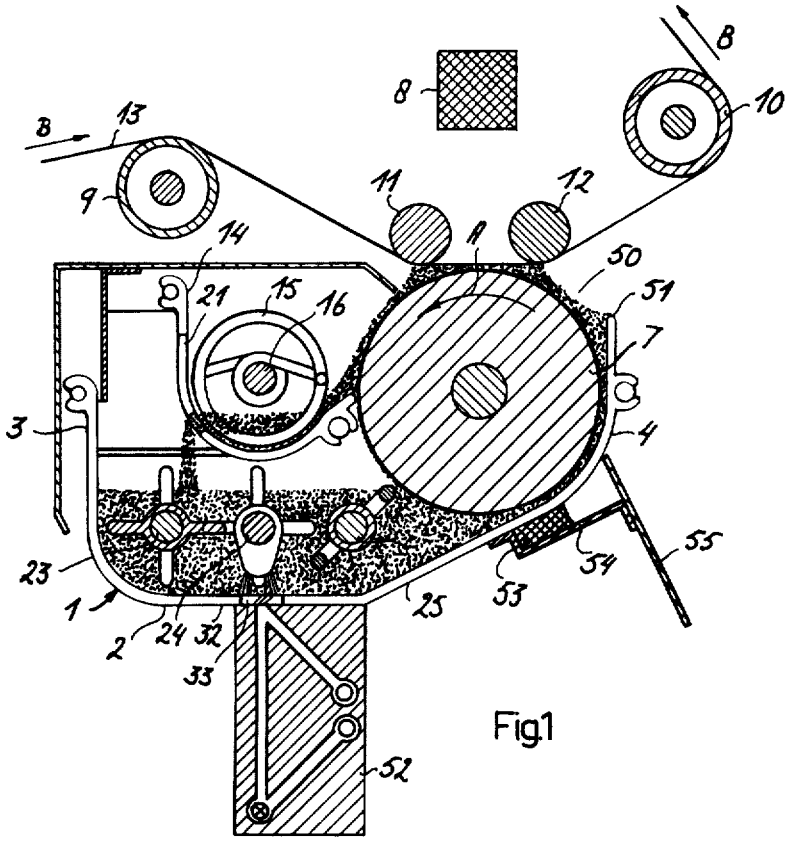
FIG. 1 is a cross-sectional view of an apparatus embodying the invention.
Figure 2:
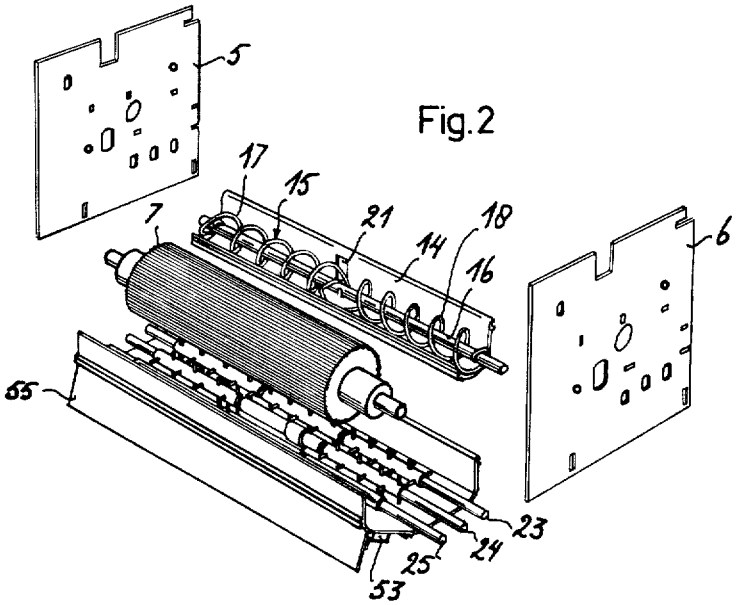
FIG. 2 is a perspective and exploded view of the principal parts of the apparatus of FIG. 1.

The apparatus for the development of electrostatic charge patterns as shown in FIGS. 1 and 2 comprises a traylike holder or receptacle 1 for the developing powder mixture, having a bottom wall 2, a front wall 3, a rear wall 4, and two side plates 5 and 6 (FIG. 2) forming the side walls. A cylinder 7 is rotatably mounted between and in bearings of the side plates 5 and 6. The cylinder cooperates with a permanent magnet 8 for the formation of the so-called magnetic brush.

Figure 6:
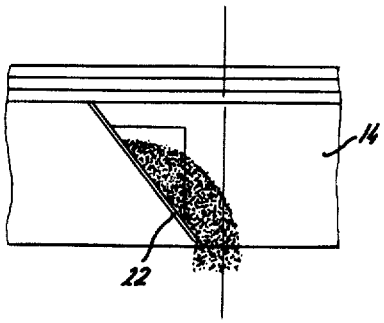
FIG. 6 is a fragmentary front elevational view of a portion of the trough and the powder guide plate in FIG. 1.
Figure 7:
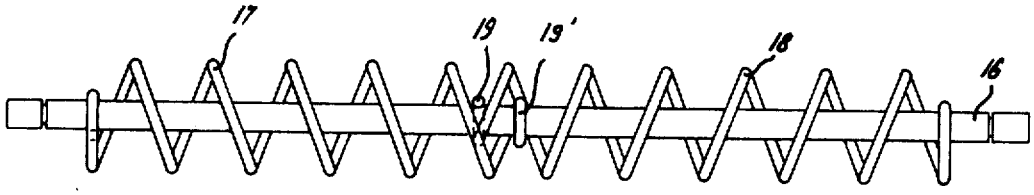
FIGS. 7 and 8 are more detailed plan and side views of the screwlike conveying elements provided in the troughlike organ according to the invention.
Figure 8:
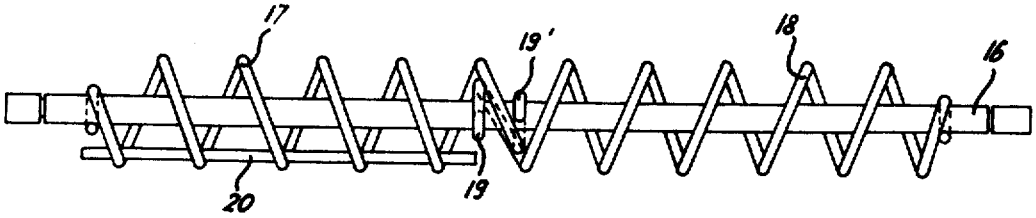

A belt 13 of photo-conductive material is guided over the upper side of the cylinder 7 by means of rollers 9 and 10 and guides 11 and 12. The belt carries a charge image which is converted into a so-called powder image by means of the magnetic brush. Further, a troughlike organ 14 is provided between the side plates 5 and 6, in which organ there is also a screwlike conveying element 15 that extends between and is mounted in bearings in the side plates 5 and 6. This screwlike element is formed by a shaft 16 (see also FIGS. 7 and 8) about which are arranged two coils or threads 17 and 18 spirally wound with opposite pitch. Each of these threads has its ends fixed to the shaft 16, with the respective inner ends 19 and 19' fixed thereto at such points that the windings of the threads 17 and 18 adjacent to these ends overlap each other and lie diametrically opposite each other over the width of an opening 21 formed in a side of the troughlike organ 14. The opening 21 is offset from the center of the trough 14, and a sloped guide plate 22 directed toward the center of the tray 1 (FIG. 6) is mounted outside the trough at and beneath the opening 21. Further, a rod 20 lying parallel to the shaft 16 is fixed against the inside of the windings of coil 17.

A permanent magnet 53 is arranged against the rear wall 4 of the tray 1 at a location close to a lower portion of the surface of cylinder 7. The magnet 53 is mounted in a bracket 54 having an elongate, downwardly sloped plate fixed to its backward edge.

Three mixing elements 23, 24 and 25 are arranged rotatably in the tray between the side plates 5 and 6, being mounted in bearings at those plates. The first mixing element 23 (see FIG. 3) comprises a shaft having fixed thereon three sleeves 26, 27 and 28 provided with diametrically opposing radial teeth. The section mixing element 24 is formed by a shaft on which are fixed two sleeves 29 and 30 having diametrically opposing radial teeth, similar to those of the sleeves 26 and 28, which protrude into the spaces between the teeth of the sleeves 26 and 28, and a central sleeve 31, not provided with teeth, is provided on the shaft of mixing element 24 between the toothed sleeves 29 and 30. A brush 32 (FIG. 1) is fixed to the central sleeve 31 so that upon rotation of the mixing element 24 this brush will sweep over a window 33 provided in the bottom wall 2 of the tray 1.

Figure 3:
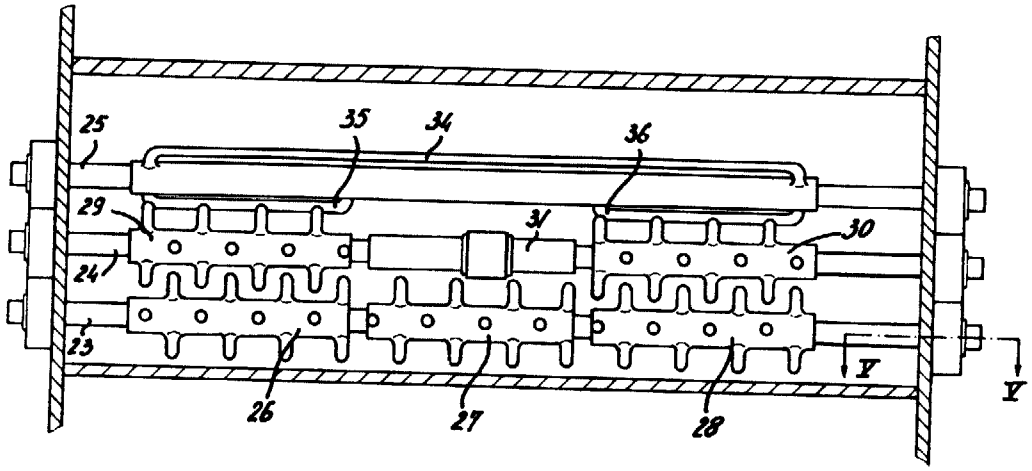
FIG. 3 is a plan view, partly in section, of the mixing organs in the lower portion of the powder collecting tray.

The third element 25 is formed by a shaft on which there is a sleeve provided with a long protruding bow 34 and with two shorter protruding bows 35 and 36 lying diametrically opposite end portions of the long bow 34. As can be seen in FIG. 3, the bow 34 extends over substantially the whole length of the mixing element 25, while the bows 35 and 36 have substantially the same lengths as the toothed end sections 29 and 30 of the mixing element 24. Thus, only one protruding bow part is present opposite the central section of mixing element 25.

Figure 9:
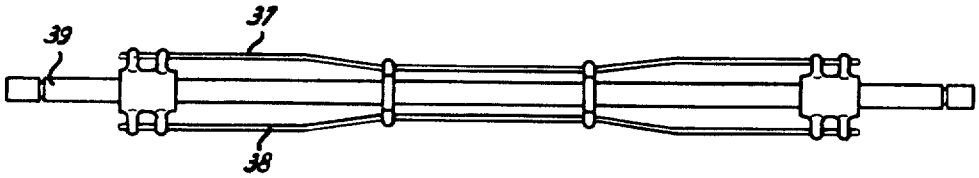
FIGS. 9 and 10 are plan and side views of another embodiment of one of the mixing organs.
Figure 10:
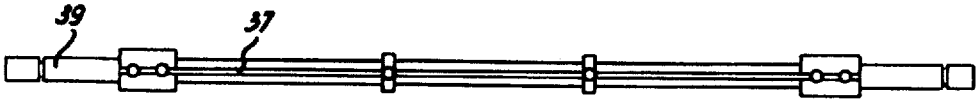

FIGS. 9 and 10 show another embodiment of a mixing element that is suitable for use in place of the mixing element 25. The element 39 of this embodiment is particularly useful in cases where a central mixing element in lieu of element 24 has three toothed sections similar to and meshing between those of the first mixing element 23. The mixing element 39 is formed by a shaft 39 having two diametrically opposite bows 37 and 38 fixed thereto. These two bows extend over substantially the whole length of the mixing element, but they are bent toward each other along the central section of the element so that in this section each of the bows 37 and 38 lies at a shorter distance from the shaft.

Figure 4:
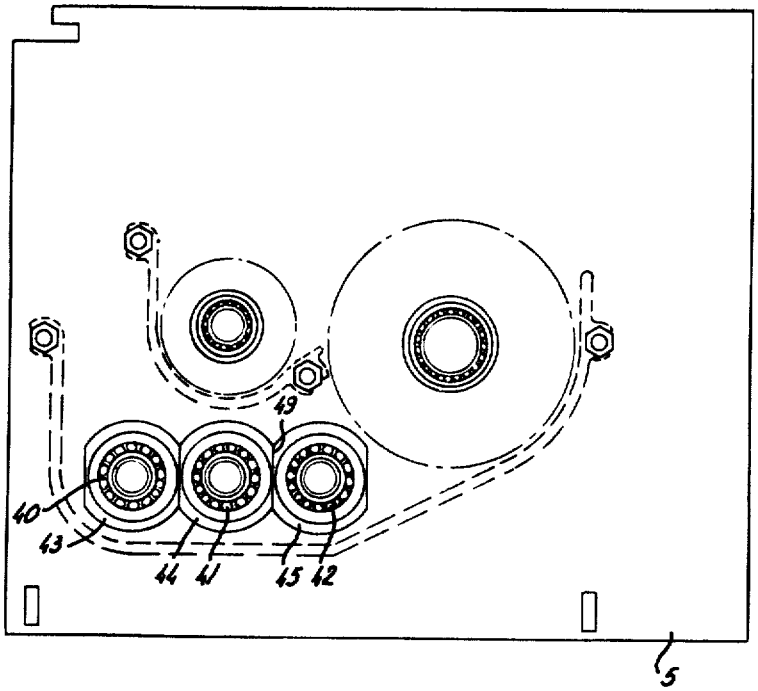
FIG. 4 is a side elevational view of one of the side walls of the apparatus of FIG. 1.
Figure 5:
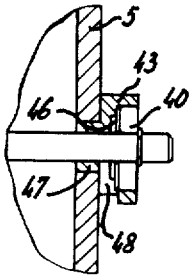
FIG. 5 is a section taken on the line V—V in FIG. 3.

The shaft ends, or journals, of the mixing elements 23, 24 and 25 are supported rotatably in the side plates 5 and 6 by means of roller bearings 40, 41 and 42 (see FIG. 4). Each set of these bearings is housed in a bushing 43, 44 or 45. Each of the bushings 43, 44 and 45 has an end wall 46 (see FIG. 5) from which a hub or sleeve 47 extends axially so as to fit precisely into an opening in one of the side plates 5 or 6. An opening bored centrally through this hub 47 and the adjacent bushing end wall 46 has an end portion of the shaft of one of the mixing elements extending through it into engagement with the set of bearings held in the bushing. At a location just outside the side plate 5 or 6, the end wall 46 of the bushing is cut away radially up to the shaft location, thus forming in the end wall a downwardly opening groove 48 which extends through a lower portion of the peripheral side wall of the bushing. In this way any toner paticles escaping between the shaft and the hub 47 of a mixing element through the opening of the hub will fall downward through the groove 48, without migrating into the roller bearings.

The bushings 43, 44 and 45 are each further provided with two diametrically opposite outside surfaces 49, forming flattenings, so that the respective bushings of the three adjacent mixing elements will abut one another along these flat surfaces near each side wall of the tray, as indicated in FIG. 4. The bushings thus are prevented from rotating with the shafts, without need for fixing them tightly to the side walls of the tray.

When the apparatus described above is in operation the cylinder 7 rotates in the direction of the arrow A shown in FIG. 1, so that a portion of the mixture of magnetizable particles and toner particles present in the tray 1 is transported with the surface of the cylinder. This developing powder is thus moved through the magnetic field formed between the permanent magnet 53 and the cylinder 7, in which field it undergoes an additional and extra strong mixing action due to the attracting and the transporting forces exerted by the cylinder on the magnetizable particles in the relatively shallow space between the surface of the cylinder and the tray wall 4 at the location of the magnetic field. Subsequently the developing powder arrives in the field of the permanent magnet 8, so that on the surface of the cylinder 7 a kind of brush is formed, which brushes against the belt of the photoconductive material 13 moving in the direction of the arrows B and thereby converts the latent charge image on this belt into a powder image. The movement of the cylinder 7 and the belt 13 in opposite directions produces an accumulation of the powder mixture in a region 50 (FIG. 1) of the approach of the mixture to the apex of the cylinder, but since the rear wall is formed with an overflow edge 51 at a level between the apex and the center of the cylinder, any excess of the mixture tending to accumulate in region 50 can flow freely over the edge 51 so as to prevent a detrimental accumulation.

The elongate downwardly sloped side plate 55 of the magnet holding bracket 54 deflects the powder falling from edge 51 laterally in a direction away from the magnet 53, thus preventing this powder from travelling to the magnet.

The magnetizable particles and the remaining toner particles in the powder mixture leaving the magnetic field of the permanent magnet 8 fall from the cylinder 7 into the trough 14, after which these particles are transported by the screwlike conveying element 15 to the opening 21, and pass through this opening 21 via the sloped guide plate 22 into the tray 1. Meanwhile, a fresh mixture of magnetizable particles and toner particles is brought into the troughlike organ 14 by means (not shown) which deliver the fresh mixture into the shorter part of organ 14 lying to one side of the opening 21. Such means are generally known and are preferably of the type disclosed in British patent specification No. 1,349,729. The teaching of which has to be considered as being incorporated here. The mixture of magnetizable particles and toner particles collected in the tray 1 is continually mixed by the rotating mixing elements 23, 24 and 25, while the concentration of the toner particles in this mixture is measured optically via the window 33 by a scanning device 52. The window 33 is kept clean for the scanning by the sweeping action of the brush 32 fixed to the central mixing element 24.

We claim:

1. In apparatus for developing an electrostatic charge image on a support by applying thereto a powder mixture of magnetizable carrier particles and toner particles, comprising a tray for holding a quantity of said mixture, said tray having a bottom wall, two side walls, a front wall and a rear wall, magnetic brush forming means including a cylinder mounted for rotation between said side walls in bearings thereon near said rear wall and a permanent magnet disposed above said cylinder, means for transporting said support over said cylinder through a magnetic field between said cylinder and said magnet, at least two mixing elements mounted for rotation between said side walls in bearings thereon near said bottom wall, and means for replenishing a deficiency of toner particles in the powder mixture in the tray, the improvement which comprises said rear wall having an overflow edge over which an excess of powder approaching the apex of said cylinder will escape at a level between said apex and the axis of the cylinder, and said replenishing means comprising means for supplying a fresh mixture of magnetizable particles and toner particles for admixture with the mixture returning to said tray from said magnetic field and the mixture in said tray.

2. In apparatus according to claim 1, the further improvement which comprises another permanent magnet that is mounted on or close to the outside of said rear wall at a location opposite a lower portion of the surface of said cylinder so that powder being moved by said cylinder from said tray is passed through the field of this other magnet.

3. Apparatus according to claim 2, said other magnet being mounted at or close to the location where the distance between said rear wall and said cylinder is the smallest.

4. In apparatus according to claim 1, the further improvement which comprises a trough mounted in space between said front wall and said cylinder and lying substantially parallel to said cylinder, for receiving the powder mixture returned down the cylinder from said magnetic field, said trough having an opening in it for delivering powder from it towards a central region of said tray, and screwlike conveyor means rotatable in the portions of said trough at opposite sides of said opening, for transporting said returned mixture to said opening.

5. Apparatus according to claim 4, said opening dividing said trough into two trough portions of unequal lengths, and a powder guide plate being mounted below said opening for directing powder delivered from said opening toward the center of said tray, said fresh mixture being delivered by said supplying means into the shorter portion of said trough.

6. Apparatus according to claim 4, said conveyor means comprising a rotatable central shaft and a thread wound spirally about said shaft in each of said trough portions, said thread having its ends fixed to the shaft and its windings being spaced from the outside of the shaft.

7. Apparatus according to claim 6, the respective spiral threads in said trough portions being on a common shaft and having opposite pitches.

8. Apparatus according to claim 7, said threads overlapping each other and lying substantially diametrically opposite each other over the width of said trough opening.

9. Apparatus according to claim 6, the inner side of the windings of said thread in said shorter trough portion having fixed thereto a rod lying substantially parallel to said central shaft.

10. In an apparatus according to claim 1, wherein said mixing elements are rotatable oblong rollers lying substantially parallel to said cylinder and each near to another in a common plane, the further improvement which conprises at least the one of said rollers which is closest to said front wall having thereon two diametrically opposite rows of mixing pins protruding from its circumferential surface, and the one of said rollers farthest from said front wall having thereon at least two diametrically opposite bowlike protruding parts each of which comprises a relatively thin rod connected therewith at least near the ends of the rod and mainly extending substantially parallel to the axis of the roller.

11. In apparatus according to claim 1, the further improvement which comprises said mixing elements including three rotatable oblong rollers lying substantially parallel to said cylinder and each near to another in a common plane, the roller closest to said front wall having two diametrically opposite rows of mixing pins protruding from its circumferential surface, the central roller comprising a central section having a predominantly smooth cylindrical surface and two end sections each of which has thereon mixing pins which protrude from its circumferential surface, and the roller farthest from said front wall having thereon protruding elongate elements in the form of bows, a first of which extends over nearly the full length of this roller and the other two of which lie diametrically opposite said first bow and each extends over a portion of the length thereof nearly corresponding to the length of one of said end sections of the central roller.

12. Apparatus according to claim 1, the further improvement which comprises said mixing elements including three rotatable oblong rollers lying substantially parallel to said cylinder and each near to another in a common plane, the roller closest to said front wall having two diametrically opposite rows of mixing pins protruding from its circumferential surface, the central roller being substantially identical to said roller closest to said front wall, and the roller farthest from said front wall having protruding therefrom two substantially identical bows lying diametrically opposite each other and formed by wires which lie closer to the circumferential surface of said farthest roller in the central region thereof than in end regions thereof.

13. Apparatus according to claim 12, said roller closest to said front wall and said central roller being installed with their repsective mixing pins so located that said pins of one of these roller protrude into the spaces between said pins of the other of them.

14. Apparatus according to claim 11, wherein said bottom wall contains a window for optical scanning of the concentration of toner particles in said mixture in said tray, said central section of said central roller having fixed thereto a brush that sweeps over said window as the central roller is rotated.

15. In apparatus according to claim 1, the further improvement which comprises said bearings of said mixing elements each being roller bearings held in a bushing having an end wall on which there is a hub fitting into an opening in one of said side walls, said hub and said end wall having an opening therethrough of a diameter to receive a shaft of one of said mixing elements, said end wall having formed therein from one side of said opening a downwardly directed groove extending through the lower side of the bushing for shedding away from the roller bearings powder particles that may pass between said shaft and said hub.

16. Apparatus according to claim 15, each of said bearing bushings having at the outer side of its side wall two diametrically opposite substantially flat surfaces whereby the adjacent bushings of the bearings of adjacent mixing elements abut one another along respective flat surfaces thereof near each side wall of said tray.

* * * * *